US006536192B2

(12) United States Patent
King et al.

(10) Patent No.: US 6,536,192 B2
(45) Date of Patent: Mar. 25, 2003

(54) DRILL BIT PACKAGES AND METHODS

(75) Inventors: William W. King, Houston, TX (US); William C. Saxman, Cedar Hill, TX (US); Jeffery Peck, DeSoto, TX (US); James S. Dahlem, Midlothian, TX (US); Karl D. Knecht, Arlington, TX (US); Lee M. Smith, Houston, TX (US); Margaret L. Parks, Dallas, TX (US); Mike Jeziorski, Miami Beach, FL (US); Patsy A. Jenner, DeSoto, TX (US)

(73) Assignees: Halliburton Energy Services, Inc., Carrollton, TX (US); Relocation Systems, Inc., Dallas, TX (US)

( * ) Notice: Subject to any disclaimer, the term of this patent is extended or adjusted under 35 U.S.C. 154(b) by 0 days.

(21) Appl. No.: 09/845,054

(22) Filed: Apr. 27, 2001

(65) Prior Publication Data

US 2002/0014425 A1 Feb. 7, 2002

Related U.S. Application Data

(60) Provisional application No. 60/218,304, filed on Jul. 14, 2000.

(51) Int. Cl.[7] ..... B29C 41/00; B65B 69/00; B65D 21/036; B65D 25/28; B65D 43/00

(52) U.S. Cl. ..... 53/476; 53/492; 206/349; 206/379; 206/508; 206/509; 220/8; 220/318; 220/772; 264/310; 414/810

(58) Field of Search ..... 206/349, 379, 206/446, 523, 525, 597, 508, 509; 53/476, 492; 156/304.2; 220/1.5, 8, 318, 772; 264/310–312; 414/810

(56) References Cited

U.S. PATENT DOCUMENTS

| | | | | | |
|---|---|---|---|---|---|
| 1,450,674 | A | * | 4/1923 | Marston | 220/8 |
| 2,960,250 | A | * | 11/1960 | Haloski | 220/772 |
| 3,964,605 | A | * | 6/1976 | Vezirian | 206/349 |
| 4,244,469 | A | * | 1/1981 | Miner | 206/349 |
| 4,545,501 | A | * | 10/1985 | Deford | 220/318 |
| 4,733,789 | A | * | 3/1988 | Olson | 206/379 |
| 4,872,563 | A | * | 10/1989 | Warder et al. | 206/523 |
| 5,111,938 | A | * | 5/1992 | Soprano et al. | 206/597 |
| 5,588,531 | A | * | 12/1996 | Yoshida et al. | 206/523 |
| 5,692,631 | A | * | 12/1997 | Tillard et al. | 220/1.5 |

* cited by examiner

*Primary Examiner*—Jim Foster
(74) *Attorney, Agent, or Firm*—Robert Groover

(57) ABSTRACT

A plastic canister for storing and shipping drill bits, especially roller cone drill bit, has a pin-holder built into the lid of the canister for ease of field dressing the bit. The lid and body of the container are slip fit to one another and indexed to each other for positive positioning in their relationship. Safety features include the use of a conductive plastic polymer, a non-rolling base, mating protrusions and recesses for stacking, recessed areas for strapping, and welded loop handles.

22 Claims, 5 Drawing Sheets

DRILL BIT PACKAGES AND METHODS

This application claims priority from U.S. provisional application 60/218,304, filed Jul. 14, 2000, which is hereby incorporated by reference.

BACKGROUND AND SUMMARY OF THE INVENTION

The present invention relates to packaging, and particularly to packaging of roller cone drill bits for shipment and/or storage.

BACKGROUND

Roller-Cone and Fixed-Cutter Bits

In contemporary drilling practice, there are two basic categories of rock drill bits: roller-cone bits and fixed cutter bits. Within each of these classifications, a range of sizes and design configurations are available.

A general schematic of a conventional rotary cone bit is shown in FIG. 6. The most common roller cone bits 60 have three independently rotating "cones" 62 (which may or be not be precisely conical) fitted on three bearings. The cones will have cutting elements 64 or "teeth" attached to, or integral with the cones. The bearings are mounted on "arms" 65 whose other ends are attached to the body of the bit. There is a threaded drill string connection 67, commonly referred to as the "pin" on the junction of the arms at the upper end of the bit. Generally at least three jet nozzles 68 are present on the bit to direct the flow of drilling "mud" toward the hole bottom. These jets come in a variety of sizes, which may be changed on the site if deemed necessary.

A general schematic of a conventional fixed cutter bit 70 is shown in FIG. 7. The most common fixed cutter bits have at one end a supporting structure referred to as the "bit head" 72. Wear-resistant cutting elements 73 are strategically located on the outer and lower surfaces of the bit head, as well as a number of jet nozzles 74. A further example of this type of rock drill bit is disclosed in U.S. Pat. No. 5,033,559 by Fischer.

A drilling site will generally have a number of bits available, both to deal with normal wear and tear of the bits, and to accommodate various conditions in the hole. A new bit will receive a final inspection to be sure that no part of it is damaged and to exchange nozzles if necessary.

BACKGROUND

Bit Packaging

While a great deal of work has been put into developing the technology of the drill bits themselves, less work has gone into the technology of shipping and storing them. The bits used for drilling oil and gas wells are consumable items which must be shipped to locations in the remotest parts of the world. Bit packaging must provide reasonable protection of bits against rough handling and corrosion during transport and storage. Bit packaging may also be subjected to rough-and-ready handling practices on the rig floor or elsewhere in the field.

There is also some difference between the shipping and storage requirements of roller-cone and fixed-cutter bits, in that roller-cone bits tend to have more of their mass concentrated away from the pin end of the bit, due to the large fraction of the bit's mass in the cones. Thus a roller cone bit is not very stable when balanced on its pin end, but is typically quite stable when allowed to rest with its pin upright.

Roller cone bits have normally been shipped in this stable pin-up position. Small drill bits (e.g. 50–200 pounds in weight) have usually been shipped in a simple box of heavyweight corrugated cardboard, as shown in FIG. 5. Since the bit containers are likely to encounter rough handling in the field, the cardboard must be very heavy-duty, and these boxes are surprisingly expensive (typically more than $50 each in wholesale quantities). Even so, these boxes are not very durable.

Fixed-cutter bits have been transported with a packaging approach as shown in FIG. 4. This is a much more elaborate design and is executed in a tough plastic. This design requires that the fixed bit has slots 44 which are designed for make-up and break-out. A U-shaped packaging piece 46 slides into the breakout slots providing a secure seating for the bit. The assembled U-shaped piece and bit are then lowered into the main portion of the package, utilizing posts 45 in the body and corresponding holes 47 in the U-shaped piece to provide an exact seating in the package. Unlike the cardboard boxes, the weight of the bit would not necessarily rest on the bottom of the container, but the weight would be transmitted by the post into the sides of the container.

One constraint on packaging is that the overall length of different bit designs may be different, even for a given hole size. A variety of bit designs are used to adapt to the various kinds of rock which must be penetrated; for example, the average hardness, peak hardness, abrasiveness, or shale content of the formation being drilled will all affect the choice of bit. The size and angulation of the cones and the type and length of teeth chosen will affect the length of the bit which must fit into a package. On the other hand, the need to have packages of varying lengths as well as breadth increases the manufacturing costs of bits.

To summarize, it is desirable that a package be sturdy and provide a stable environment for transporting the bit, as well as being as easy to handle as possible. Protection from the environment is desirable, as are safety concerns which arise from the handling of these awkward, often heavy pieces of equipment. At the same time, the economics of producing the packaging must be considered.

Rotational Molding

Rotational molding is an inexpensive way to form large, molded plastic items. A hollow mold is created, then filled with a measured amount of a plastic powder. The mold is heated, to cause the powder to fuse together on the mold, and rotated, to cause the plastic powder to provide an even coverage. Once the desired surface is coated, the mold is cooled and the article removed.

Innovative Packaging and Methods for Drill Bits

The present application describes a new approach to packaging, transport and/or storage of drill bits. This new approach includes a number of innovations which can be used separately, in combination, or in various subcombinations.

In at least some embodiments, a two-piece, cylindrical polymer container, formed by rotational molding, holds a roller cone in a cones-down position. A cushion of foam in the bottom of the container provides cushioning and lateral stability to the bit, while the lid provides a holder to stabilize the pin. The lid and body, which are slip fit to each other, are preferably held together by strapping, which is preferably constrained within channels formed in the package.

In at least some embodiments, the package has a bottom end which is shaped to avoid rolling during transport (e.g.

square or hexagonal). Use of a conductive polymer minimizes static electricity on the rig floor. Mating protrusions and indentations on the lid and bottom of the package help to stabilize the bit containers when stacked.

In at least some embodiments, unsafe handling practices are discouraged by welded loop handles and the retention of strapping within grooves in the package, which will be explained in more detail later.

The disclosed innovations, in various embodiments, provide one or more of at least the following advantages:

durability, relatively inexpensive to manufacture, reusable, one package can handle a range of bits of a given bore size;

promotes safe handling of packaged bits.

BRIEF DESCRIPTION OF THE DRAWING

The disclosed inventions will be described with reference to the accompanying drawings, which show important sample embodiments of the invention and which are incorporated in the specification hereof by reference, wherein:

FIGS. 1A–B show perspectives of the innovative container, first with the lid off, then with it on.

DETAILED DESCRIPTION OF THE PREFERRED EMBODIMENTS

The accompanying drawings show important sample embodiments of the invention and are incorporated in the specification hereof by reference.

Figure 1A:
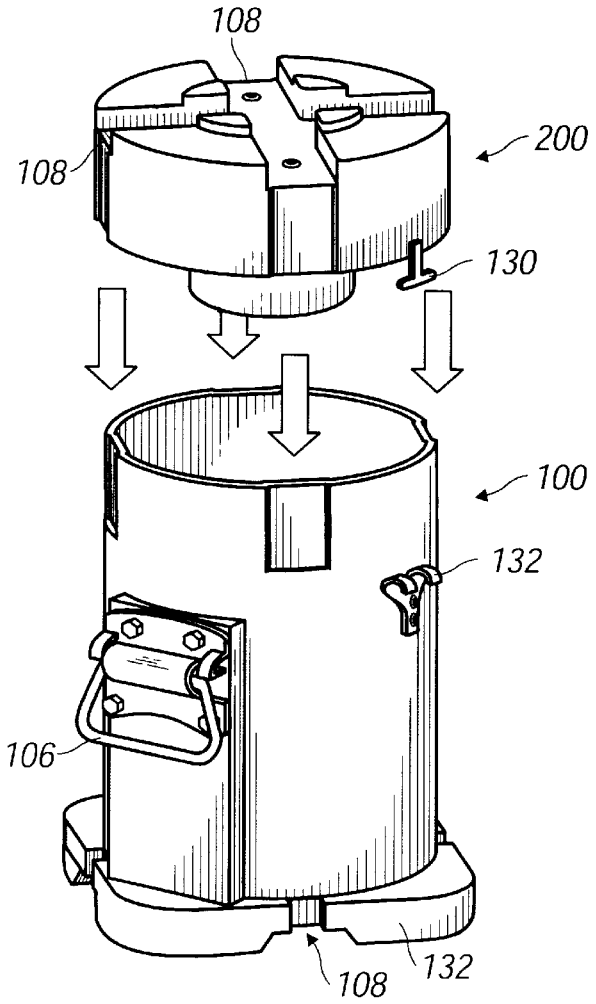
Figure 1B:
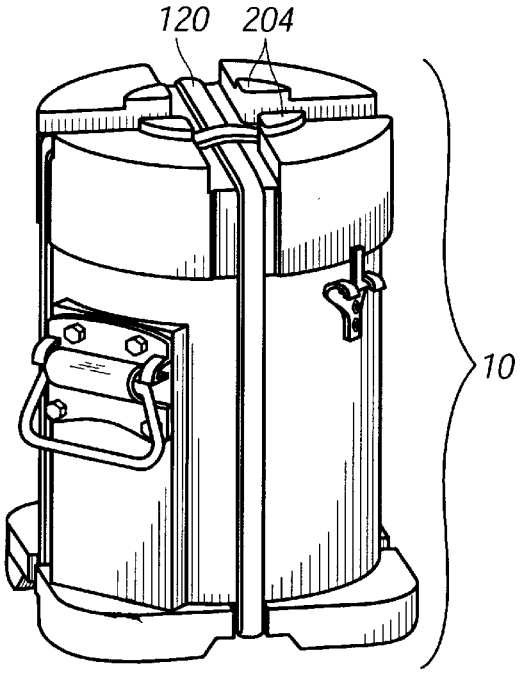

In an exemplary preferred embodiment, shown in FIGS. 1*a*–1*b*, the container 10 consists of a body 100 and lid 200, which together form a generally cylindrical shape. The inside diameter of the lid 200 is very slightly larger than the body 100, providing a slip fit between the two. The lid overlaps the body for at least several inches, providing a more hermetic seal. The base 110 of the body, unlike the rest of the container, is not round, but has a shape, such as the square shown, which discourages rolling if the container falls on its side. Recessed channels 108 in the lid and base, and reproduced in the upper portion of the body of the container, provide a secure routing for the strapping which will hold the lid on the container during shipping. Sturdy handles 106 are offset from the strapping channels 108 to provide a means for hand or machine lifting. Finally, protrusions 204 in the lid of the container are sized to fit inside a cavity in the base of the container, providing some locking together of containers when they are stacked.

In this sample embodiment, the body and lid are formed from low-density polyethylene, with glycerol monostearate (GMS) added to increase the conductivity. The walls of the container body are in the range of 0.25" to 0.375" thick. A cushion of an elastomer foam is fastened in the bottom of the container and is generally several inches thick.

When a roller cone drill bit is ready for shipment, it is placed cones-down inside the body of the container, with the cones resting on the foam cushion. The lid slip-fits onto the top of the body, and is fastened to the body by strapping. Inside the lid, a pinholder sleeve 210 secures the pin end of the bit from loose lateral movement. The cone end of the bit is laterally stabilized by the contact between the cone teeth and the cushion. When the bit is packaged, a desiccant is generally added to the package to absorb moisture and discourage corrosion. This can be any number of commercially available desiccants.

Preferably the polymer lid is fastened to the body for shipping by strapping 120 only, and not by any other attachment mechanism. This is a safety feature, since strapping (unlike latches, fasteners, or molded screw threads) is not likely to be partly fastened: usually strapping will be either intact or broken, and it is easy to see which. By contrast, it is possible for built-in latches to break, or for some fasteners to be lost, or for screw thread engagements to be left untightened. The currently preferred strapping is a steel strapping, the ends of which are generally fastened together by a metal "staple", whose ends are bent over. A nylon strapping can also be used to secure the lid.

When the packaged bit is to be prepared for use at a remote location, the preferred package can be turned upside down, the strapping cut, and the body of the container lifted off. The pinholder sleeve in the lid stabilizes the bit in the cones-up position, providing a stable platform so that nozzles can easily be changed out. Other "bit-dressing" operations, as well as inspection, can also be easily performed in this position.

In the presently preferred embodiment, a further feature has been added to the container to secure the lid after the strapping is removed. In this feature, two heavy-duty T-shaped rubber straps 130 are attached to opposite sides of the lid, offset from the handles. Two generally U-shaped metal catches 132 on the container itself mate with the straps to hold the lid closed.

In an alternate class of embodiments, a temporary strapping, e.g. of nylon, can be included in the container for closing the lid after the initial opening, but this is less preferable, since unattached items are more easily lost.

Details of the Lid

Figure 2A:
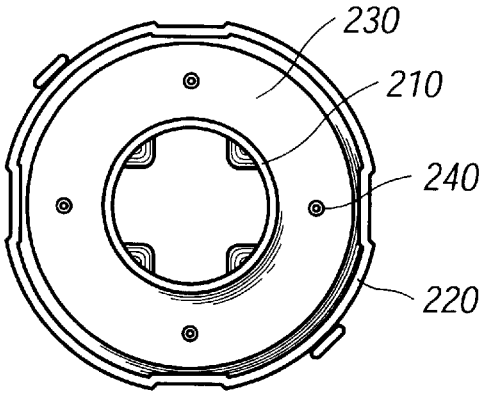
FIGS. 2A–B show the inside of the lid looking straight down into it and a perspective, showing the pin holder.
Figure 2B:
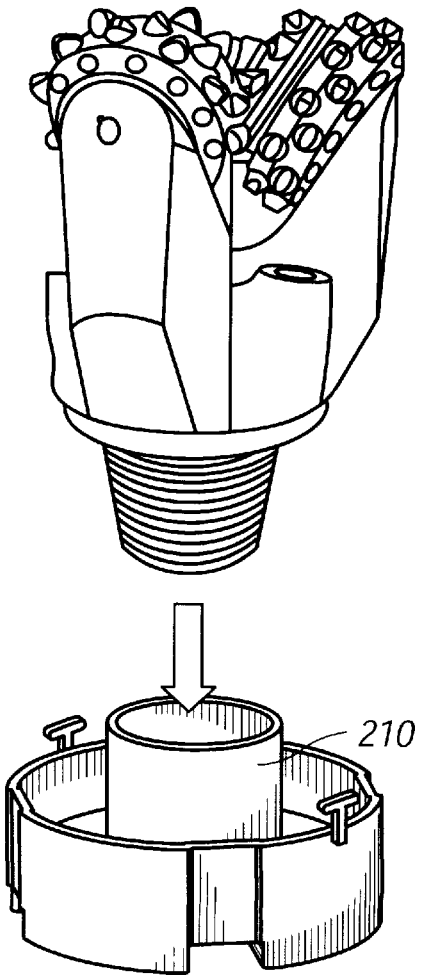

The inside of lid 200 is seen in FIGS. 2A–B. The cylindrical pin holder 210 is seen in the perspective of FIG. 2B, but is seen only as a thin circle in FIG. 2A. The construction of the lid requires some further explanation. Rotational molding is preferably used to form the body and lid. Rotational molding is a very economical and reliable procedure, but it is limited in the range of shapes which can be formed. The present inventors found that rotational molding could not easily make a compact lid with a rigidly attached integral pinholder. In the presently preferred embodiment, two pieces are cut out from a single hollow molding, and then attached together to form the lid with integral pinholder. The first piece 220 forms the portion of the lid which is visible when the lid is in place on the container, and has generally cylindrical sides and a circular top, with grooves and protrusions formed into it. The second, inner piece 230 is seen in FIG. 2*a* as a flat-doughnut-shaped piece, from which rises the cylindrical pin holder. The inner and outer portions are preferably attached together with liquid-tight rivets 240, so that the closed container will have reasonably good environmental sealing. This combination provides a strong structure which uses only a single-layer shell for most of the lid area.

Details of the Body

Figure 3:
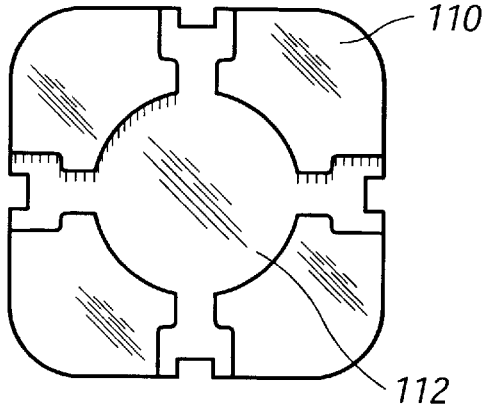
FIG. 3 shows the bottom of the container.
Figure 4:
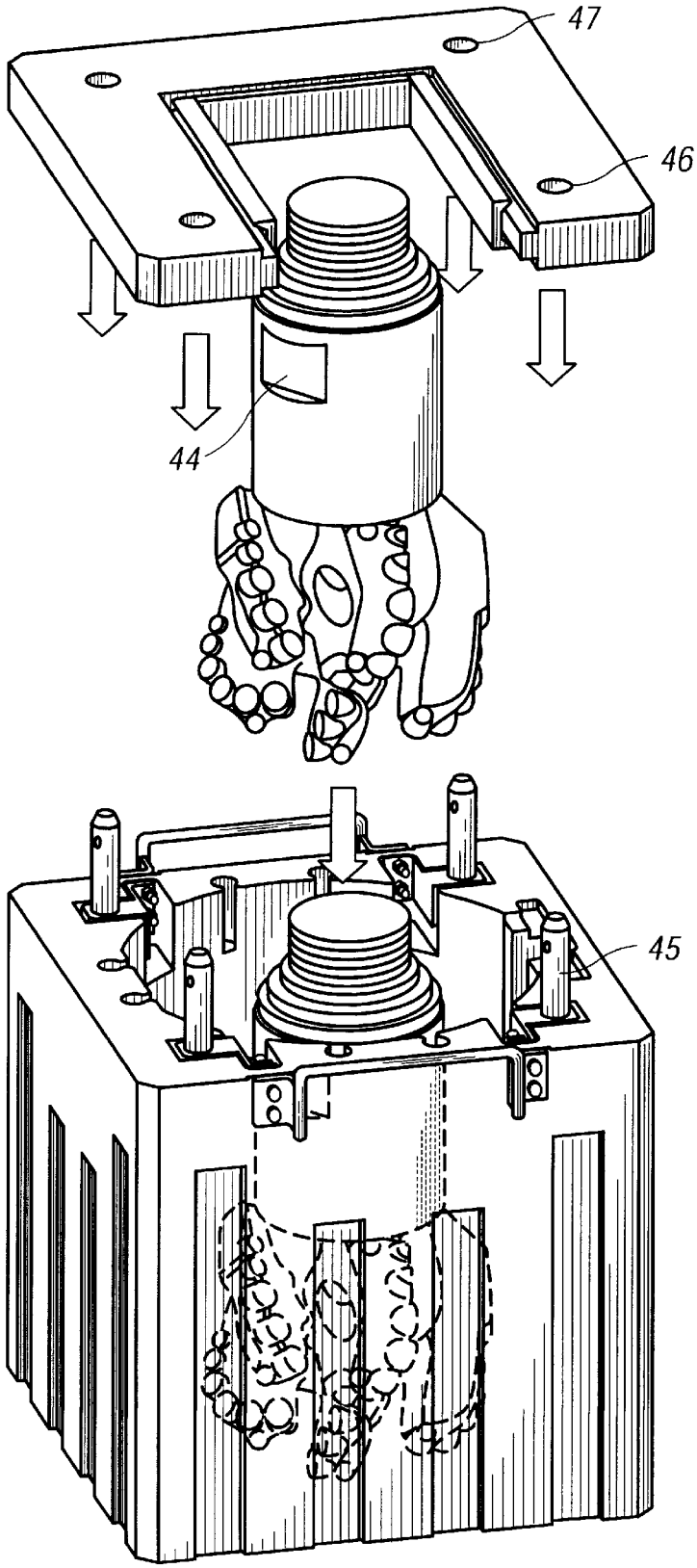
FIG. 4 ( PRIOR ART )
FIG. 4 shows a prior art package in which fixed-cutter bits have been transported.
Figure 5:
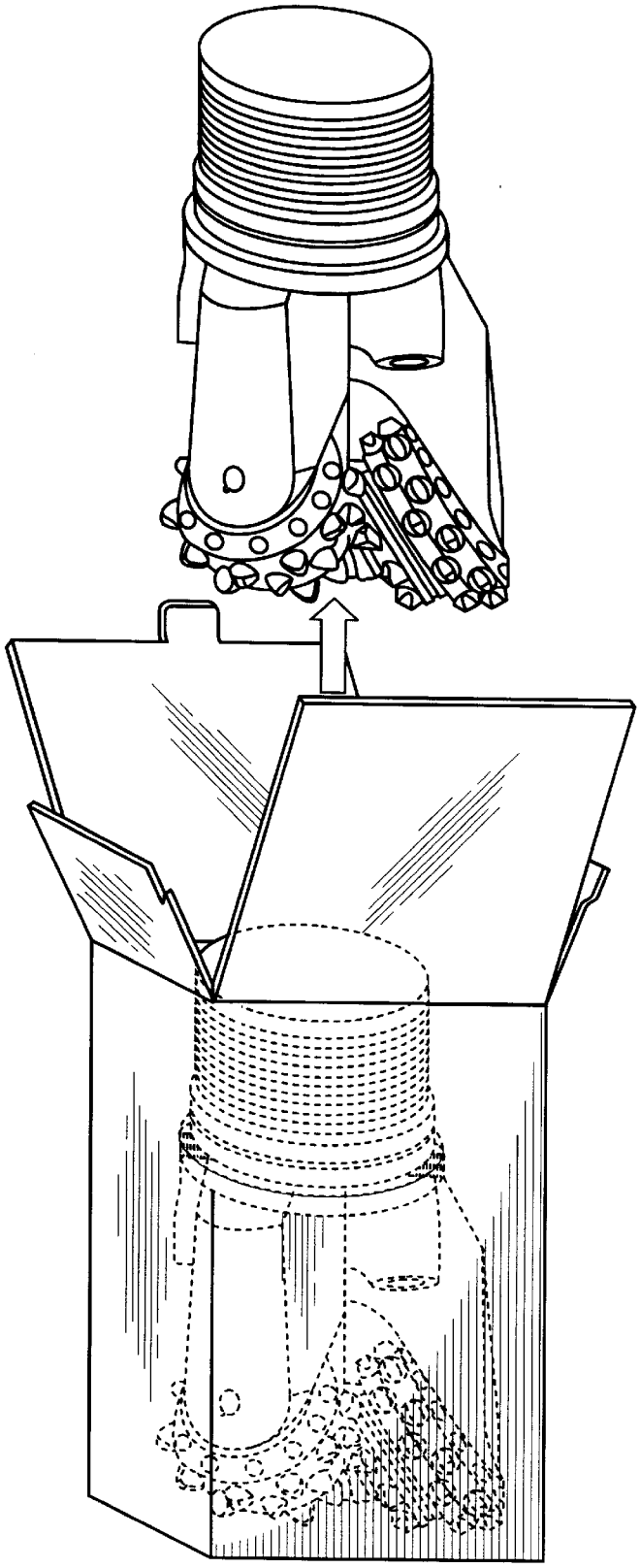
FIG. 5 ( PRIOR ART )
FIG. 5 shows a sample box of heavyweight corrugated cardboard in which small drill bits have usually been shipped in the past.
Figure 6:
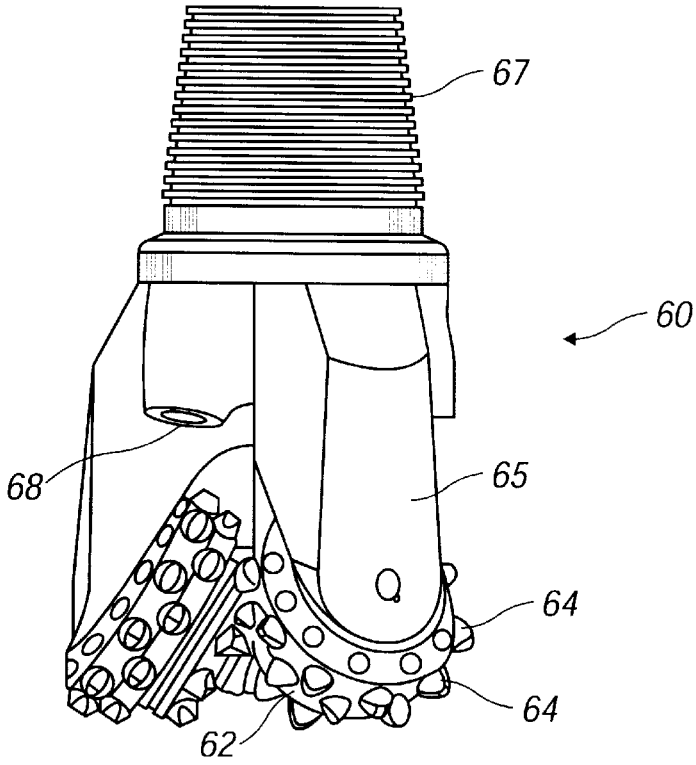
FIG. 6 shows a general schematic of a conventional rotary cone bit.
Figure 7:
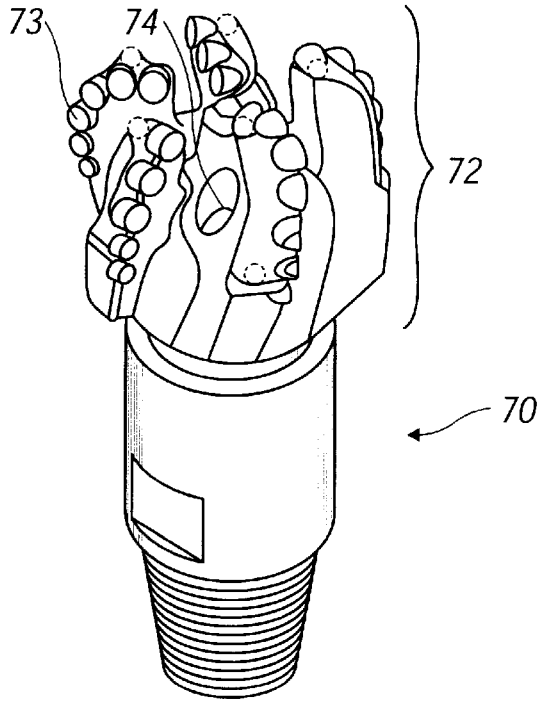
FIG. 7 shows a general schematic of a conventional fixed cutter bit.

In addition to the perspective of the container shown in FIGS. 1A–1B, a bottom view of the body 100 of the container is shown in FIG. 3. While the walls of the container body are generally cylindrical in shape, this is not the case with the angular base 110, which provides anti-rolling stability. The base is here shown as having a generally square shape, but can be hexagonal, triangular, or any other shape which discourages rolling. The handles 106, offset from the strapping grooves, are clearly seen. These handles are very heavy-duty, and have a 90 degree stop to prevent fingers being mashed between the handle and the wall of the container by heavy loads. The handles are attached to the container by studs, which are molded into the container as it is formed. Additionally, the walls of the container are somewhat thicker from near the outer edges of the handles downward, in order to provide a flat area for attachment of the handles.

In FIG. 3, the base of the body is all that is visible, since this base is somewhat larger than the rest of the body. In addition the grooves which hold the strapping, a circular area 112 is indented into the base. When a container is stacked on top of a similar container, the protrusions 204 in the lid of the lower container will engage in the circular indentation 112 of the upper container. This prevents slippage between the relatively slick surfaces of the two containers.

Safety Issues

Several features of the preferred embodiment are designed to discourage unsafe handling practices. This is a particular challenge with bit sizes which have weights in the range from (e.g.) 30 to 300 pounds. In this intermediate zone of weights, manual handling is possible but workers are also likely to use lifting aids when available. This results in a challenge for bit package design: the package design should facilitate manual handling, but not encourage the use of lifting equipment in an unsafe manner. The preferred embodiment contains a number of innovations which address this concern.

For instance, the container with bit is preferably lifted, either manually or machine-assisted, using both handles. However, it has been assumed that under working conditions, workers will inevitably try to use a quicker method, such as attaching a lifting hook to only one handle, or worse, trying to use the strapping which holds the lid on as a lifting point.

To address the first of these lifting practices, the inventors tested a number of commercially available "heavy-duty" handles, which use an open loop of bent rod for the handle. These stock handles were strong enough for normal manual handling, but if the container snagged on other equipment while being machine lifted, one end of the loop can be pulled out of its restraint, allowing the whole package to fall. Instead, the handles are specially made, with the ends of the loop welded together. Even under much higher stress, these handles will not come open. For instance, although the bit and container will generally weigh little more than 300 pounds, each handle can handle at least 800 pounds pressure without breaking. Additionally, a stop on the handle keeps the loop from rotating more than about 90 degrees outward from the package. This provides a comfortable position for handling, but keeps fingers from being mashed between the handle and the container.

For the second of the bad lifting practices above, the fact that the strapping is recessed into grooves makes it much harder to simply slip a lifting hook through the strapping. Since this strapping is not designed to take this abuse, making this practice more difficult improves safety. The lip of the body contains indentations which register with corresponding shapes in the lid, to assure that the strap grooves in the body will align with those in the lid.

Another safety feature is the use of a conductive polymer material. The use of a conductive material minimizes static electricity, and thus the risks of explosion or fire on the rig floor.

Other Advantages

This package is not only very durable, but also relatively inexpensive to fabricate. The preferred package is durable enough that it can be reused if desired. Additionally, this design provides a reasonable range of tolerances as far as height of the bit is concerned. With a slip fitting lid, the lid does not need to be seated all the way down on the body, so a single package size can hold most normal roller cone bits of a given bore size. If desired, the sides of the lid can be designed to extend to just above the handles, allowing even more leeway for longer bits.

Example of Dimensions

At this time, the containers are being made in three sizes to accommodate the varying sizes of drill bits. Dimensions of the middle size container are given below as an example. This should not be taken to be a limitation on what can be done.

Total weight—10 lbs.

Weight of lid—3 lbs.

Weight of base—7 lbs.

Overall height—17½"

Diameter—11"

Height of lid—4½"

Depth of groove on lid—¾"

Depth of groove in bottom—⅜"

Height of protrusions on lid—¼"

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

It is specifically contemplated that the disclosed inventions are not limited to roller cone bits, but can also be applied to drag bits. It is also specifically contemplated that the disclosed packaging devices and inventions are not limited to packaging of bits, but can be used for downhole motors, bent subs, workover tools, core bits, reamers, hole openers, or in other components motors, bent subs, or for other tools.

Further information on drill bits can be obtained from The Rotary Drilling Series, Unit I, Lesson 2: The Bit (fourth edition), published by the Petroleum Extension Service of The University of Texas at Austin in cooperation with the International Association of Drilling Contractors, which is hereby incorporated by reference.

What is claimed is:

1. A container for transportation and storage of a drill bit, comprising recessed grooves, intersecting in an upper surface of said container, which are shaped to hold strapping in proper positioning; and projections in said upper surface, adjacent both said grooves, mating with corresponding indentations which are located in a lower surface of the container; wherein said container has an internal shape which confines an Earth-penetrating threaded-pin rotary cone drill bit therein.

2. The container of claim 1, further comprising strapping which runs in said recessed grooves of said container.

3. The container of claim 1, wherein said container contains handles offset from said recessed grooves.

4. The container of claim 1, further comprising a rotary cone drill bit positioned inside said container and having a pin end laterally supported by a sleeve in the underside of a lid of said container and having cones supported by a foam layer on the bottom of said container.

5. The container of claim 1, further comprising a rotary cone drill bit positioned inside said container and laterally supported thereby.

6. A container adapted aid sized for transportation and storage of an Earth-penetrating drill bit having a threaded pin end, said container having a layer of foam in the bottom thereof, and also having a pinholder sleeve; wherein the lateral positioning of the bit within said container is determined solely by said pinholder sleeve which holds said pin end and by the contact between the bit and the layer of.foam in the bottom of said container.

7. The container of claim 6, further comprising a rotary cone drill bit therein.

8. The container of claim 6, wherein said pinholder sleeve is part of a lid of said container.

9. The container of claim 6, wherein said bit has a maximum weight in the range between 30 and 300 pounds inclusive.

10. A container for transportation and storage of an Earth-penetrating threaded-pin drill bit, said container comprising a polymer body, wherein a first section of said container is substantially cylindrical and a second portion of said container has a polygonal shape which is not conducive to rolling of said container; and an Earth-penetrating threaded-pin drill bit inside the container;

wherein said container has an internal shape confining said drill bit therein.

11. The container of claim 10, wherein said polymer is a conductive polymer.

12. A container for transportation and storage of a drill bit, said container comprising a polymer body and a polymer lid, said lid having a pinholder sleeve attached to the underside of said polymer lid; wherein said lid is a two-piece lid held together with liquid-tight rivets.

13. The container of claim 12, wherein said container has an internal shape which confines a rotary cone drill bit therein.

14. A container for transportation and storage of an Earth-penetrating drill bit having a threaded pin end, said container comprising a body and a lid having a reduced dimension sleeve therein adapted to hold the pin end of a bit within the container, said lid mating with and overlapping the outer surface of the side of said body;

whereby said container accommodates multiple different bit lengths.

15. The container of claim 14, wherein said container has an internal shape which confines a rotary cone drill bit therein.

16. A system of containers according to claim 14 for transportation and storage of drill bits, wherein one respective size of container fits Earth-penetrating rock bits of multiple different bore sizes.

17. The system of containers of claim 16, wherein said one size of container fits all bits-of a given pin size.

18. A method of preparing a drill bit for use in the field, comprising the steps of:

inverting a container in which said drill bit is stored; and removing a body of said container so that said drill bit remains pin-down in a pinholder which is part of a lid of said container.

19. A method of preparing a drill bit for use, comprising the steps of:

cutting strapping to open a container in which said drill bit is stored, said container comprising a body and a lid;

inspecting and/or dressing said drill bit; and resealing said lid and said body other than with said strapping material which was cut.

20. The method of claim 19, wherein said lid and said body are resealed using a nylon strapping included with said container.

21. The method of claim 19, wherein said lid and said body are resealed using a rubber strap and a metal catch, one of which is on said lid and the other of which is on said body.

22. A method of manufacturing a container for the transportation of drill bits, said method comprising:

rotationally molding a single hollow piece;

cutting said single hollow piece to form first and second lid pieces;

fastening said first and second lid pieces together to make a lid having a pinholder on the inside of said lid.

* * * * *